United States Patent [19]

Roche

[11] Patent Number: 4,494,042

[45] Date of Patent: Jan. 15, 1985

[54] MERCURY TARGET SENSING AND LOCATING APPARATUS

[75] Inventor: William J. Roche, Merrimac, Mass.

[73] Assignee: GTE Products Corporation, Stamford, Conn.

[21] Appl. No.: 368,939

[22] Filed: Apr. 16, 1982

[51] Int. Cl.[3] ..... H01J 7/44; H01J 13/46; H01J 19/78; H01J 29/96

[52] U.S. Cl. ..... 315/56; 313/565; 315/58; 315/63; 445/73

[58] Field of Search ..... 324/403, 410, 414; 313/492, 490, 565; 315/291, 56, 58, 59, 61, 63; 316/30

[56] References Cited

U.S. PATENT DOCUMENTS

| | | | |
|---|---|---|---|
| 2,654,051 | 9/1953 | Kenty | 324/414 |
| 3,249,859 | 5/1966 | Speros et al. | 324/414 |
| 3,967,191 | 6/1976 | Roche | 324/414 |
| 4,051,407 | 9/1977 | Van der Werf et al. | 324/DIG. 5 |

*Primary Examiner*—Saxfield Chatmon
*Attorney, Agent, or Firm*—Thomas H. Buffton

[57] ABSTRACT

Apparatus is provided for sensing a mercury dispensing target within an arc-discharge lamp and connecting a DC voltage source thereto to effect current flow and heating of the mercury dispensing target in an amount sufficient to effect dispersion of the mercury within the lamp.

12 Claims, 1 Drawing Figure

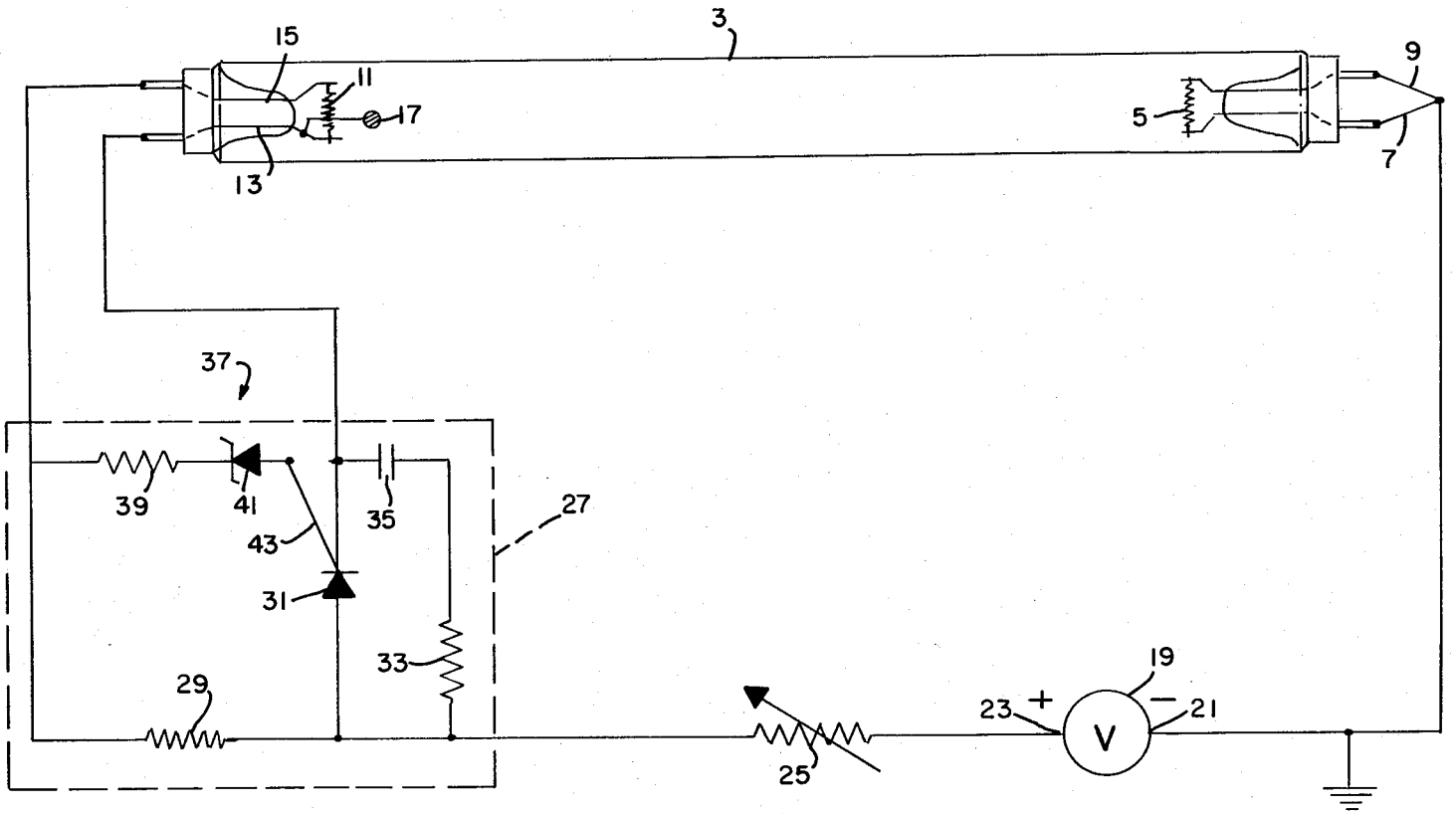
9
7
5
3
17
11
15
13
19
21
23
25
27
35
33
37
41
43
31
39
29

MERCURY TARGET SENSING AND LOCATING APPARATUS

TECHNICAL FIELD

This invention relates to apparatus for sensing and locating a mercury dispensing target in a lamp and more particularly to apparatus for sensing the positional location of a mercury dispensing target in a lamp and for selectively applying a voltage thereto for effecting energization of the target.

BACKGROUND ART

Generally, it has long been a practice to dispense liquid mercury into a lamp after the lamp has been exhausted and hermetically sealed. In order to efficiently and safely effect such mercury dispersion, numerous techniques have been employed. For example, liquid mercury has been introduced into a lamp by way of the exhaust tubualtion of the lamp. However, such techniques have frequently been considered both hazardous and expensive.

Other methods for effecting liquid mercury release in an evacuated envelope include the containment of the liquid mercury in a glass or metal container with a wire wrapped about the glass container. Thereafter, heat preferably in the form of RF energy, is utilized to effect a rupturing of the container and dispersement of the liquid mercury.

Another approach to the dispensing of a liquid mercury in an arc lamp is set forth in a co-pending application U.S. Ser. No. 374,605, entitled "Method of Dispensing Mercury Into A Fluorescent Lamp And Lamp To Operate With Method," filed in the names of the inventor of the present application and Ralph P. Parkes, Jr., and assigned to the Assignee of the present application. Therein a mercury dispensing target is located within an exhausted lamp having a coil at each end of the lamp. The dispensing target is affixed to one lead of one of the coils and positioned intermediate the coils disposed at opposite ends of the lamp. A direct current is passed through the lamp and the dispensing target functions as the anode and collects the discharge current in an amount sufficient to heat the target and dispense the mercury therein.

Although the above-described technique has been and still is suitable for use in a variety of structures, it has been found that there are lamps and structures available wherein special conditions are desirable. More specifically, a lamp having a coil at one end connected to a DC potential source and a coil with a pair of electrical leads having a mercury dispensing target connected to one of the electrical leads at the opposite end of the lamp requires that the electrical lead having the target thereon be connected to the potential source. In this manner, the mercury dispensing target collects and is heated by a high proportion of the electric current. It can readily be seen that a lamp having a pair of electrical leads with the mercury dispensing target on one of the leads could be connected to the potential source in a manner such that the lead with the target thereon is not the one connected to the potential source. Thus, the dispenser target would fail to collect a high proportion of the electron current, fail to heat and fail to dispense the liquid mercury.

SUMMARY OF THE INVENTION

An object of the present invention is to provide improved apparatus for sensing and energizing a mercury dispensing target in an arc discharge lamp. Another object of the invention is to enhance the dispensing of liquid mercury in an arc discharge lamp. Still another object of the invention is to provide apparatus for sensing a mercury dispensing target within a lamp envelope and coupling the sensed target to a potential source.

These and other objects, advantages and capabilities are achieved in one aspect of the invention by an arc discharge lamp having a coil at each end, a DC potential source coupled to one coil, a mercury dispensing target affixed to a lead of the other coil and a ballast connected to the DC potential source and to a voltage discriminator coupled to the other coil.

BRIEF DESCRIPTION OF THE DRAWING

The sole FIGURE is a combination schematic and diagrammatic illustration of a preferred form of arc discharge lamp mercury dispensing target sensing apparatus.

BEST MODE FOR CARRYING OUT THE INVENTION

For a better understanding of the present invention, together with other and further objects, advantages and capabilities thereof, reference is made to the following disclosure and appended claims in conjunction with the accompanying drawing.

Referring to the drawing, an arc discharge lamp or fluorescent lamp 3 has a first coil 5 at one end thereof with first and second electrically conductive leads 7 and 9 connected to the first coil 5 and extending external of the lamp 3. A second coil 11 is positioned at the opposite end of the lamp 3 and includes first and second electrically conductive leads 13 and 15 extending outwardly of the lamp 3. A mercury dispensing target 17 is affixed to one of the first and second electrically conductive leads 13 and 15 of the second coil 11 and positioned in front of the second coil 11 or intermediate the second and first coils 11 and 5 respectively.

A DC voltage source 19, such as a 400-volt, 800 ma DC potential source for example, has a first terminal 21 connected to a potential reference level or circuit ground and to the first and second electrically conductive leads 7 and 9 of the first coil 5. The other terminal 23 of the DC voltage source 19 is connected to a ballast 25 in the form of an adjustable resistance, for example.

Coupled to the ballast 25 and to the electrically conductive leads 13 and 15 of the second coil 11 is a voltage discriminator 27. The voltage discriminator 27 has an impedance 29, in the form of a resistor, coupling the ballast 25 to the second electrically conductive lead 15 of the second coil 11. A rectifier with a control electrode, such as a silicon controlled rectifier 31, shunted by a series connected resistor 33 and capacitor 35, couples the ballast 25 to the first electrically conductive lead 13 of the second coil 11. A voltage dependent switch 37, illustrated as a series connected resistor 39 and zener diode 41, is coupled intermediate the junction of the impedance 29 and second electrically conductive lead 15 and a control electrode 43 of the silicon controlled rectifier (SCR) 31.

As to operation, it is known that liquid mercury may be dispensed within a lamp by a mercury target technique. As discussed in the previously referenced co-pending application entitled "Method Of Dispensing Mercury Into A Fluorescent Lamp And Lamp To Operate With Method," electron heating may be utilized to dispense pre-measured quantities of mercury into an arc-discharge device. More specifically, a mercury dispensing target is affixed to a coil at one end of the lamp which functions as the anode in the electron discharge cycle.

Further, it is known that the target must serve to collect the discharge current and thereby inhibit the discharge from spreading over the body of the coil to which the target is affixed. It is the level of discharge current collected by the target which determines the heating level of the target. Moreover, the mercury release time, which is preferably as short as possible, is determined by the level of target heating.

However, in order for the mercury target to collect a high proportion of the available electron current, the circuit power supply must be connected to the same electrical lead of the coil as the one to which the mercury target is attached. Thus, it is obvious that a lamp having first and second electrically conductive leads with a mercury target affixed to one of them, could be inserted into the circuit to provide two different connections, i.e., the lead with the affixed target or the lead without a target connected to the DC potential.

Referring to the drawing, the negative terminal 21 of the DC voltage source 19 is connected to the electrical leads 7 and 9 of the first coil 5 at one end of the lamp 3. The positive terminal 23 of the DC voltage source 19 is connected via the ballast 25 and resistor 29 to the electrically conductive lead 15 of the second coil 11 at the other end of the discharge device 3. Thus, current in the circuit will be established through the path defined by the DC voltage source 19, ballast 25, impedance 29, the second electrically conductive lead 15 and the lamp 3. Since the SCR 31 is in a non-conductive state, no current flow will be established through the first electrically conductive lead 13.

The current flowing into the lamp 3 via the second electrically conductive lead 15 will generate a voltage $V_f$ across the second coil 11 having a polarity which is positive at the second electrically conductive lead 15 with respect to the first electrically conductive lead 13. Since there will be very little current at the mercury dispensing target 17 under such conditions, the target 17 will not heat in the manner necessary to mercury dispension.

However, the voltage $V_f$ resulting from the above-described connections and conditions will appear across the electrically conductive leads 13 and 15 wherein the second electrically conductive lead 15 will be positive with respect to the first electrically conductive lead 13. When this developed voltage $V_f$ exceeds the breakdown voltage of the voltage dependent switch 37, current flow will be established in a circuit comprising the second electrically conductive lead 15, resistor 39, zener diode 41, control electrode of the SCR 31 and back to the first electrically conductive lead 13. Thereupon, the SCR 31 is rendered conductive, and current will flow from the ballast 25 through the SCR 31 to the first electrically conductive lead 13. Thus, current flow will be transferred to the mercury dispensing target 17 which will result in heating thereof and release of the mercury therein.

Should the lamp 3 be inserted in the opposite condition wherein the first electrically conductive lead 13 is connected to the impedance 29 with the target 17 still affixed thereto, a different conductive path would be established and continued. In this instance, current would flow by way of the DC potential source 19, ballast 25, impedance 29, first electrically conductive lead 13 connected thereto, the mercury dispensing target 17 and the lamp 3. Since a major portion of the current would be developed at the mercury dispensing target 17, a very small voltage would be developed across the second coil 11 which would be less than the threshold voltage of the voltage dependent switch 37. Thus, the desired heating of the target 17 would be achieved without energization of the SCR 31.

Apparatus has been provided for activating a mercury dispensing target in a fluorescent lamp having a pair of electrical connections regardless of the connections made to the lamp. The apparatus has the capability of adapting to the connections made between a DC potential source and a lamp to provide the desired potentials and heat to a mercury dispensing target affixed within the lamp.

While there has been shown and described what is at present considered the preferred embodiments of the invention, it will be obvious to those skilled in the art that various changes and modifications may be made therein wihtout departing from the invention as defined by the appended claims.

I claim:

1. Apparatus for coupling a fluorescent lamp to a DC potential source, said fluorescent lamp having a first coil at one end, a second coil with a pair of connected electrical leads at the opposite end with a mercury dispensing target affixed to one of said pair of electrical leads, said apparatus formed for selectively applying energy from said DC potential source to said electrical lead having said mercury dispensing target affixed thereto and comprising:

means for coupling said DC potential source to said first coil of said fluorescent lamp;

a ballast connected to said DC potential source; and voltage discriminator means coupling said ballast to said second coil of said fluorescent lamp, said voltage discriminator means including an impedance coupling said ballast to one and a rectifier coupling said ballast to the other one of said pair of electrical leads and a voltage dependent switch coupled to said rectifier and to the junction of said impedance and to one of said pair of electrical leads whereby energy from said ballast is selectively coupled by said impedance or said rectifier to said electrical lead having said mercury dispensing target affixed thereto in accordance with the development of a voltage across said second coil of a value less than or greater than the breakdown voltage of said voltage dependent switch.

2. The improvement of claim 1 wherein said rectifier with a control electrode is a silicon control rectifier (SCR).

3. The improvement of claim 1 wherein said voltage dependent switch is in the form of a zener diode.

4. The improvement of claim 1 wherein said impedance is in the form of a resistor.

5. The improvement of claim 1 wherein said voltage discriminator includes a series connected capacitor and resistor shunting said rectifier with a control electrode.

6. The improvement of claim 1 wherein said mercury dispensing target is affixed to said second electrical lead of said second coil, said second coil develops a potential sufficient to effect conduction of said voltage dependent switch causing conduction of said rectifier and application of a potential from said ballast to said second electrical lead.

7. The improvement of claim 1 wherein said mercury dispensing target is affixed to said first electrical lead of said second coil, said second coil develops a potential insufficient to effect conduction of said voltage dependent switch and a potential from said ballast is applied by way of said impedance to said first electrical lead of said second coil.

8. Apparatus for coupling a potential source to a fluorescent lamp having a first coil at one end and a second coil at the opposite end with said second coil having a pair of electrical leads connected thereto and a mercury dispensing target affixed to one of said pair of electrical leads, said apparatus formed for selectively applying energy from said potential source to said electrical lead having said mercury dispensing target affixed thereto and comprising a means for coupling said potential source to said first coil, a ballast connected to said potential source and characterized by the improvement wherein a voltage discriminator means has an impedance coupling said ballast to one and a rectifier coupling said ballast to the other one of said pair of electrical leads and a voltage dependent switch coupled to said rectifier and to the junction of said impedance and one of said pair of electrical lead whereby energy from said ballast is selectively coupled by said impedance or said rectifier to said electrical lead having said mercury dispensing target affixed thereto in accordance with development across said second coil of a voltage less than or greater than the breakdown voltage of said voltage dependent switch.

9. The improvement of claim 8 wherein said discriminator includes an impedance coupling said ballast to one of said first and second electrical leads.

10. The improvement of claim 8 wherein said discriminator includes a silicon controlled rectifier (SCR) coupling said ballast to one of said first and second electrical leads.

11. The improvement of claim 8 wherein said discriminator includes an impedance coupling said ballast to one of said first and second electrical leads, a silicon controlled rectifier (SCR) coupling said ballast to the other one of said first and second electrical leads and a zener diode coupling a junction of said ballast and first electrical lead to said silicon controlled rectifier (SCR).

12. The improvement of claim 8 wherein said voltage discriminator includes an SCR coupling said ballast to said second electrical lead and a series connected capacitor and resistor shunts said SCR.

* * * * *